US008272307B1

(12) United States Patent
Holmes et al.

(10) Patent No.: US 8,272,307 B1
(45) Date of Patent: Sep. 25, 2012

(54) APPARATUS AND METHOD FOR RETAINING SCREW BREECH BLOCK

(75) Inventors: Edward W. Holmes, Valley Falls, NY (US); Wayland P. Barber, Mechanicville, NY (US); Leslie C. Blahut, Westfield, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 47 days.

(21) Appl. No.: 12/950,082

(22) Filed: Nov. 19, 2010

(51) Int. Cl.
*F41B 11/00* (2006.01)

(52) U.S. Cl. ..... 89/19; 124/66

(58) Field of Classification Search ..... 89/17–26; 124/64–68

See application file for complete search history.

(56) References Cited

U.S. PATENT DOCUMENTS 1,396,404 A * 11/1921 Burton et al. ..... 124/67
2,865,255 A * 12/1958 Marsh ..... 89/163
3,142,294 A * 7/1964 Baldwin, Jr. ..... 124/67
3,821,920 A * 7/1974 Brieger ..... 89/132
H1121 H * 12/1992 Carroll et al. ..... 89/27.13
7,246,549 B1 * 7/2007 Van Dyke-Restifo et al. ..... 89/27.13
7,357,058 B1 * 4/2008 Olcott ..... 89/26
7,469,623 B1 * 12/2008 Olcott ..... 89/27.3
7,779,740 B1 * 8/2010 Holmes et al. ..... 89/27.12
7,845,264 B2 * 12/2010 Van Dyke-Restifo et al. ..... 89/27.13
8,141,469 B1 * 3/2012 Holmes et al. ..... 89/17
2007/0151439 A1 * 7/2007 Van Dyke-Restifo et al. ..... 89/27.13
2010/0282059 A1 * 11/2010 Van Dyke-Restifo et al. ..... 89/27.13

* cited by examiner

*Primary Examiner* — Michael David
(74) *Attorney, Agent, or Firm* — Michael C. Sachs

(57) ABSTRACT

A breech-loaded weapon may include a carrier at its breech end. The carrier may include a breech block support. A screw block may be rotatable on the breech block support of the carrier. The carrier may include a supporting protuberance and the screw block may include a supporting projection having an undercut portion. A spring-loaded plunger may be disposed on the carrier and a plunger recess may be defined in the screw block. In a retained position of the screw block, the undercut portion of the supporting projection may engage the supporting protuberance of the carrier and the spring-loaded plunger may engage the plunger recess.

12 Claims, 7 Drawing Sheets

APPARATUS AND METHOD FOR RETAINING SCREW BREECH BLOCK

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to breech-loaded direct and indirect fire weapons, such as, for example, cannons and mortars.

A known method of retaining a screw breech block to the carrier of a cannon or a breech-loaded mortar may be accomplished by a spindle and obturator pad assembly. The screw breech block, spindle, and obturator pad assembly may be all held together by a nut-type of component on the threaded breech end of the spindle. When the spindle and obturator pad assembly are removed, the screw breech block may no longer be retained. The screw breech block may only remain on the carrier when a horizontal swing breech mechanism is at horizontal elevation. Otherwise, for example, on a vertical swing cannon, the screw block may fall off the carrier.

During the course of daily spindle and seal inspections, the screw block may necessarily be removed because it is may not be retained and may otherwise fall off the carrier. Furthermore, during reassembly of the spindle, extra time may be allotted to re-engage the block gear before the spindle and seal assemblies can be reassembled. The traditional removal method for the screw breech block may be tedious and may require a two-person team to complete. One person may be needed to remove the spindle and another person may be needed to prevent the screw breech block from falling.

There is a need for a more effective method and apparatus for retaining the screw block to the carrier. A more effective method and apparatus may allow maintenance and inspection of the spindle and obturator assembly to be performed by a single person.

SUMMARY OF THE INVENTION

It is an object of the invention to provide a more effective method and apparatus for retaining the screw block to the carrier of a breech-loaded weapon.

One aspect of the invention is an apparatus for the breech end of a breech-loaded weapon. The apparatus may include a carrier having a breech block support. A screw block may be rotatable on the breech block support of the carrier. A supporting protuberance may be disposed on the carrier. A supporting projection may be disposed on a rear surface of the screw block. The supporting projection may include an undercut portion. A spring-loaded plunger may be disposed on the carrier. A plunger recess may be defined in the rear surface of the screw block.

In a retained position of the screw block, the undercut portion of the supporting projection may engage the supporting protuberance of the carrier and the spring-loaded plunger may engage the plunger recess.

Rotation of the screw block on the breech block support may be constrained by first and second barrier surfaces on the carrier. The supporting projection of the screw block may include a first stop surface. In the retained position of the screw block, the first stop surface of the screw block may abut the first barrier surface of the carrier.

The supporting projection of the screw block may include a second stop surface. In a released position of the screw block, the second stop surface of the screw block may abut the second barrier surface of the carrier.

In the released position of the screw block, the spring-loaded plunger may be disengaged from the plunger recess. In the released position of the screw block, the undercut portion of the supporting projection may be disengaged from the supporting protuberance of the carrier.

Another aspect of the invention is a breech-loaded weapon. The weapon may include a carrier disposed at a breech end of the weapon. The carrier may include a breech block support. A screw block may be rotatable on the breech block support of the carrier. A supporting protuberance may be disposed on the carrier, and a supporting projection may be disposed on a rear surface of the screw block. The supporting projection may include an undercut portion. A spring-loaded plunger may be disposed on the carrier, and a plunger recess may be defined in the rear surface of the screw block.

A further aspect of the invention is a method that may include locking the rotation of a screw block of a weapon by engaging a spring-loaded plunger attached to a carrier with a plunger recess in the screw block. The method may include retaining the screw block on the carrier by engaging a supporting protuberance disposed on the carrier with a supporting projection disposed on the screw block.

Retaining the screw block may include engaging the supporting protuberance with an undercut portion of the supporting projection.

The method may further include releasing the screw block by removing the spring-loaded plunger from the plunger recess. Releasing the screw block may include rotating the screw block. Rotating the screw block may include disengaging the supporting protuberance from the supporting projection.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
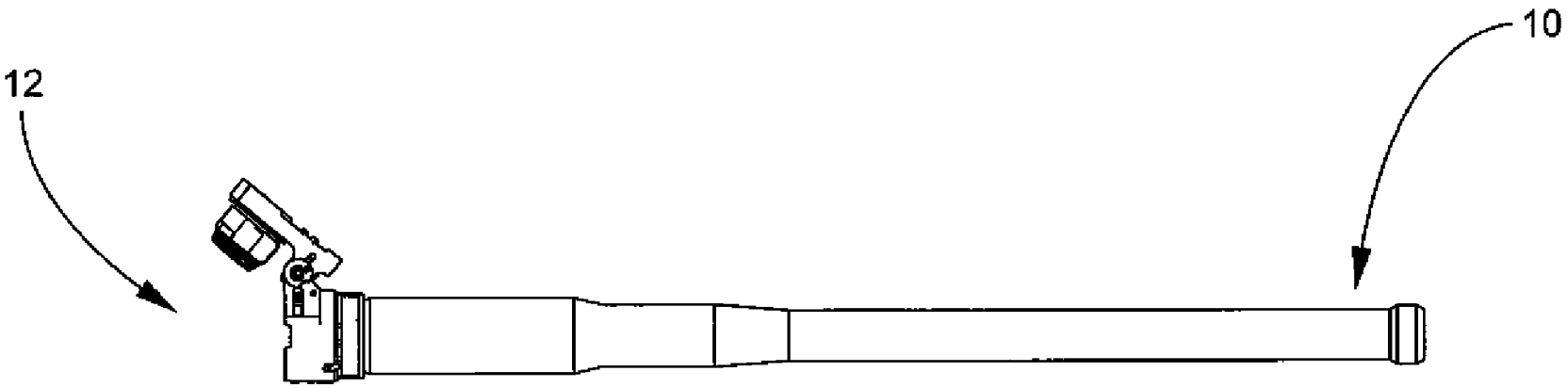
FIG. 1 is a schematic drawing of a breech-loaded weapon.
Figure 2:
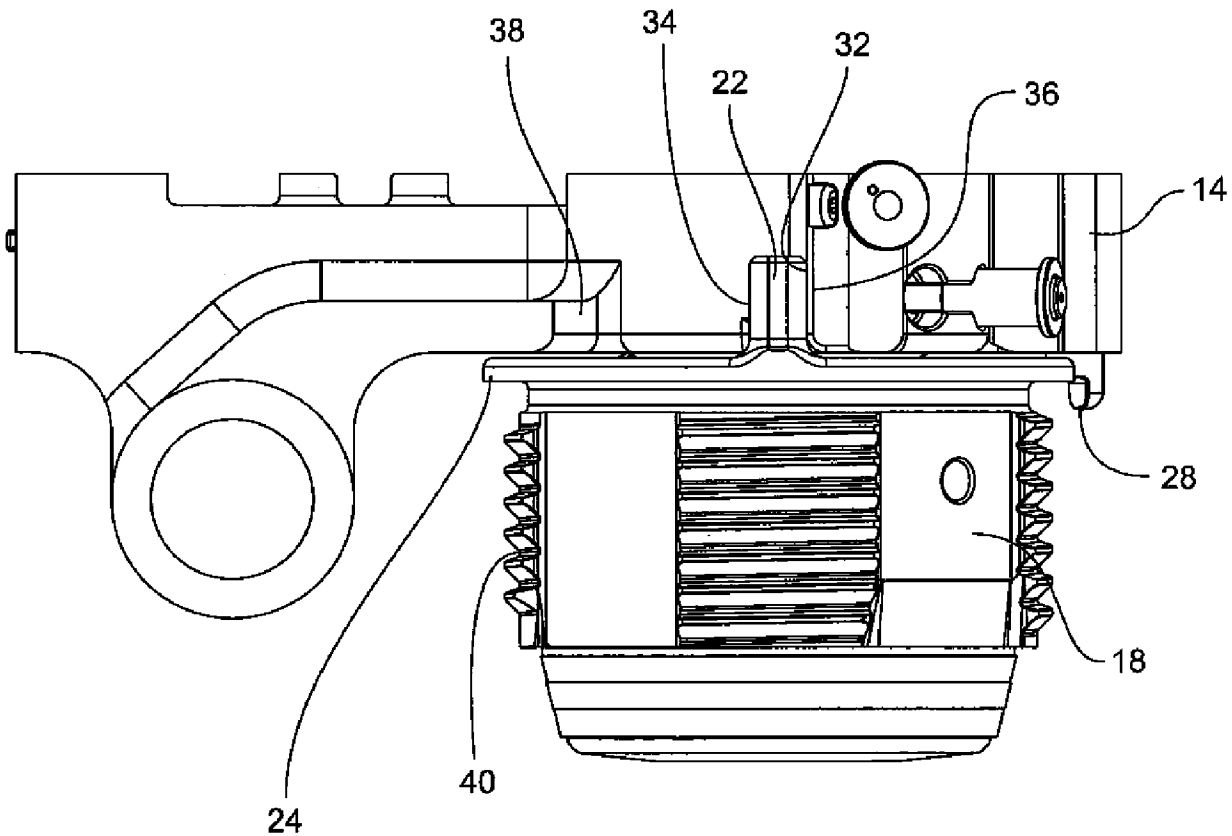
FIG. 2 is a side view of a screw breech block and carrier assembly with the screw breech block in the retained position.
Figure 3:
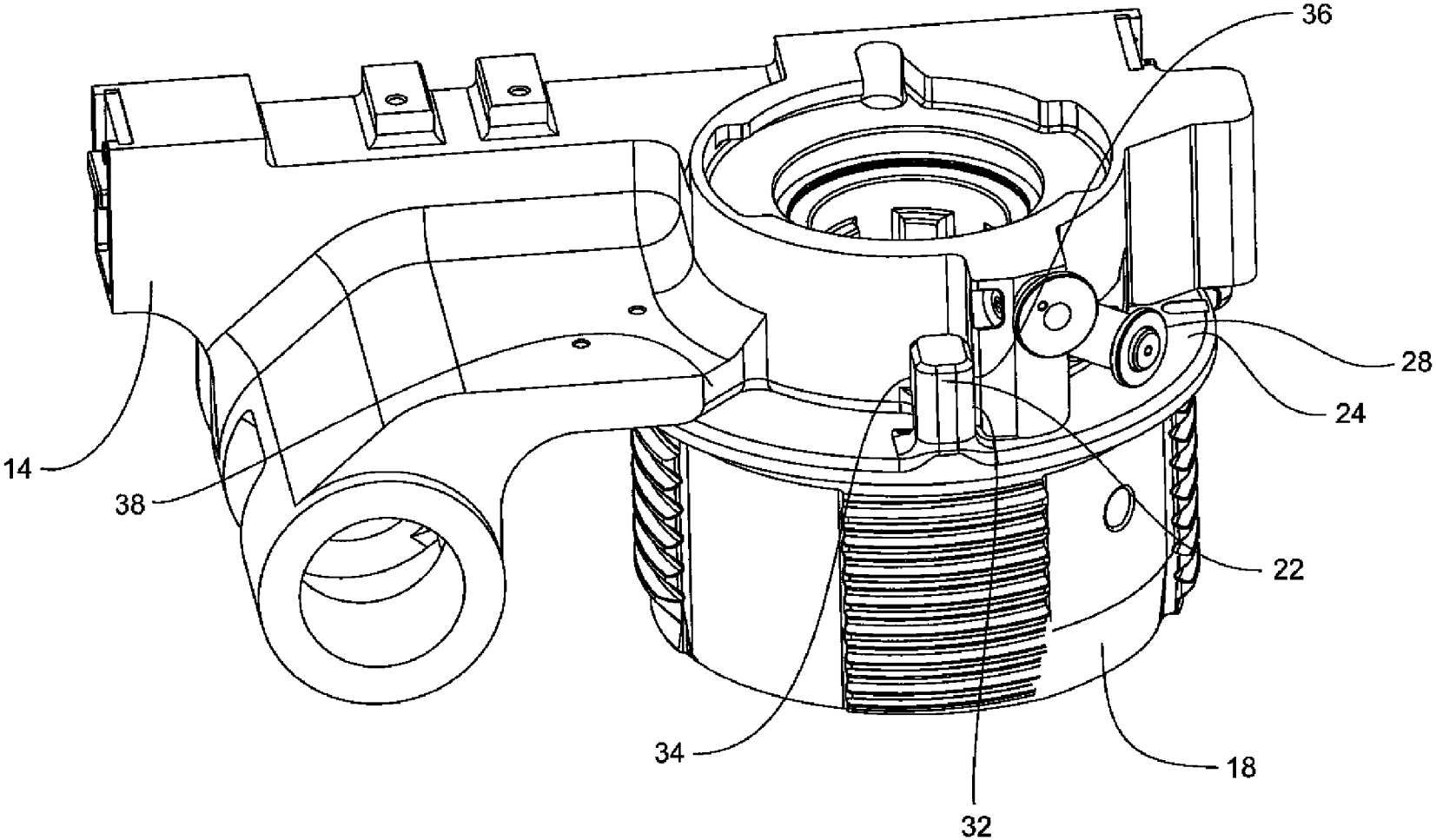
FIG. 3 is a perspective view of a screw breech block and carrier assembly with the screw breech block in the retained position.
Figure 4:
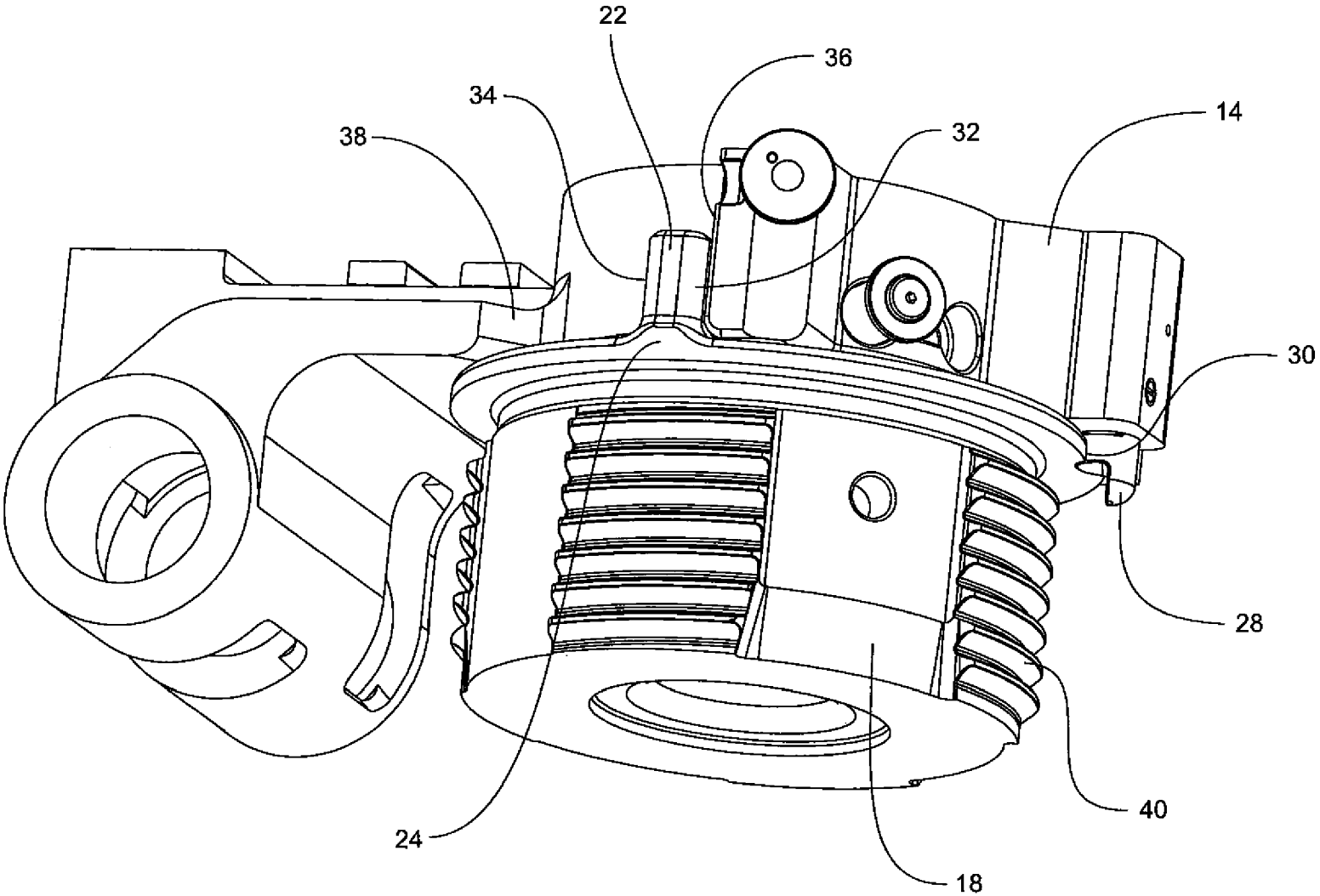
FIG. 4 is a perspective view, from another angle, of FIG. 3.

FIG. 1 is a schematic drawing of a breech-loaded weapon 10 with a breech end 12. Breech end 12 may include a screw breech block and carrier assembly. FIG. 2 is a side view of a screw breech block 18 and carrier 14 with screw breech block 18 in a retained position. Screw block 18 and carrier 14 may be components of a breech-loaded, vertical swing, screw-block cannon or mortar system, for example. A spindle and obturator pad assembly are not shown in the Figures. FIGS. 3 and 4 are perspective views of FIG. 2.

Figure 6:
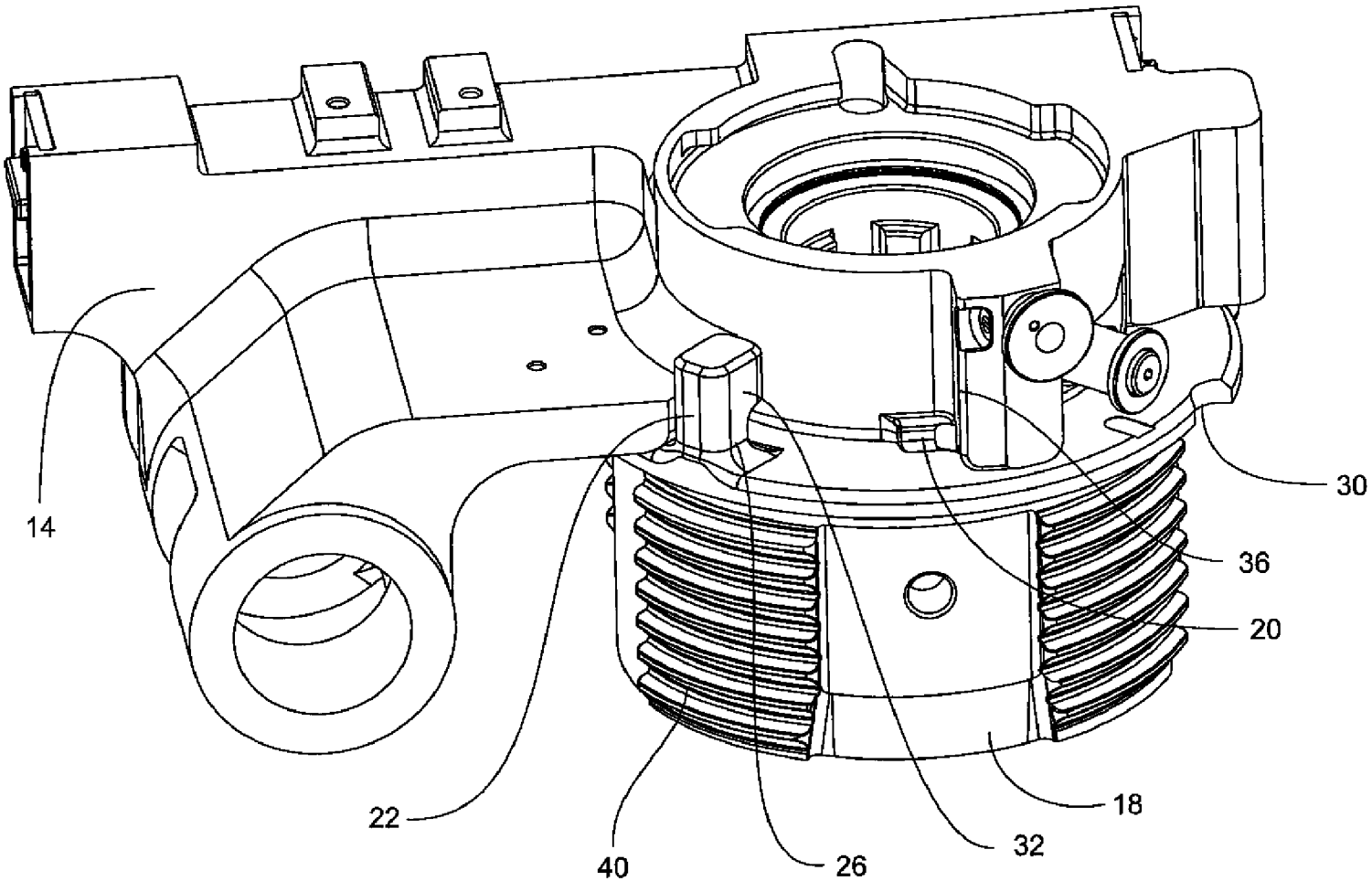
FIG. 6 is a perspective view of a screw breech block and carrier assembly with the screw breech block in the released position.
Figure 7:
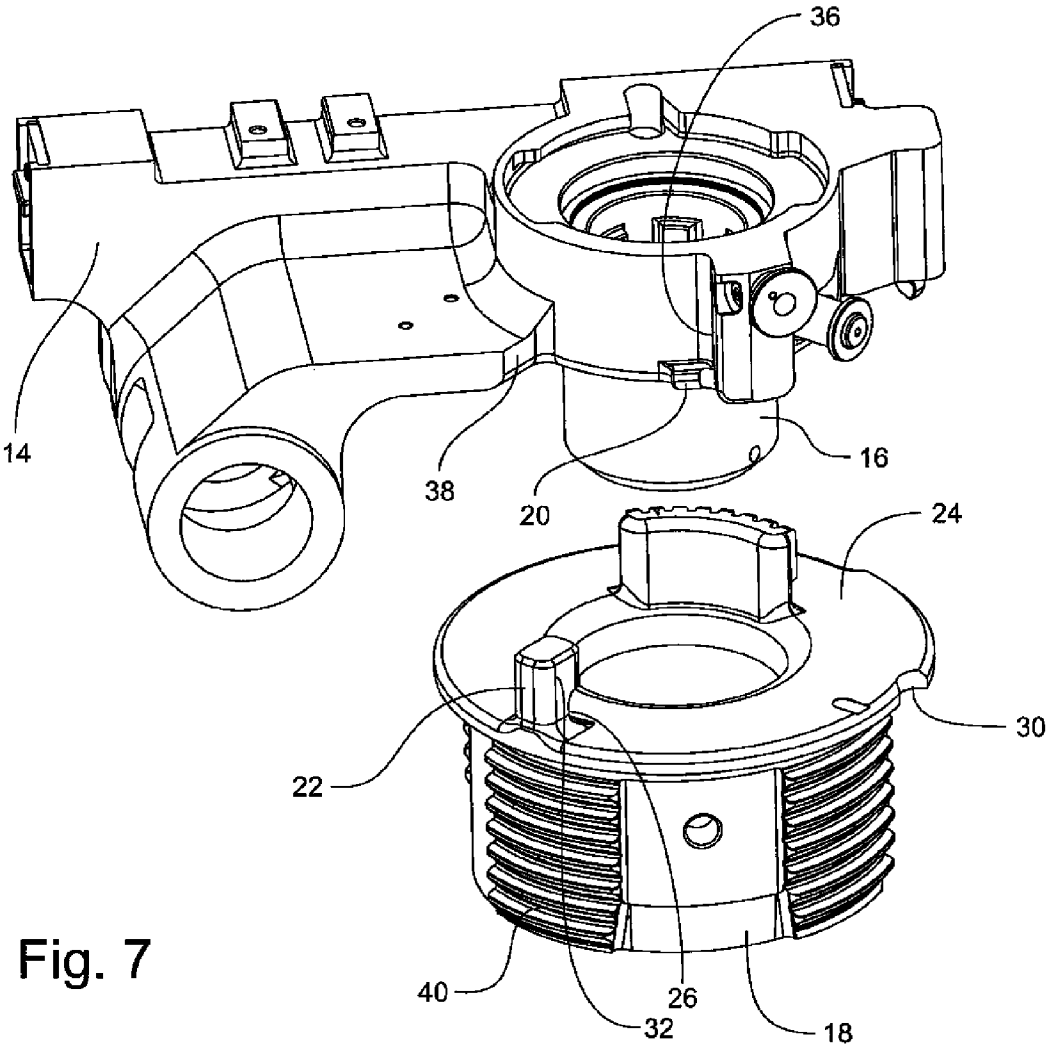
FIG. 7 is a perspective view of a screw breech block and carrier assembly with the screw breech block removed from the carrier assembly.

Carrier 14 may include a breech block support 16 (FIG. 7). Screw block 18 may be rotatable on breech block support 16 of carrier 14. A supporting protuberance 20 (FIGS. 5-7) may be disposed on carrier 14. Supporting protuberance 20 may be of sufficient strength to support the weight of screw block 18.

Figure 5:
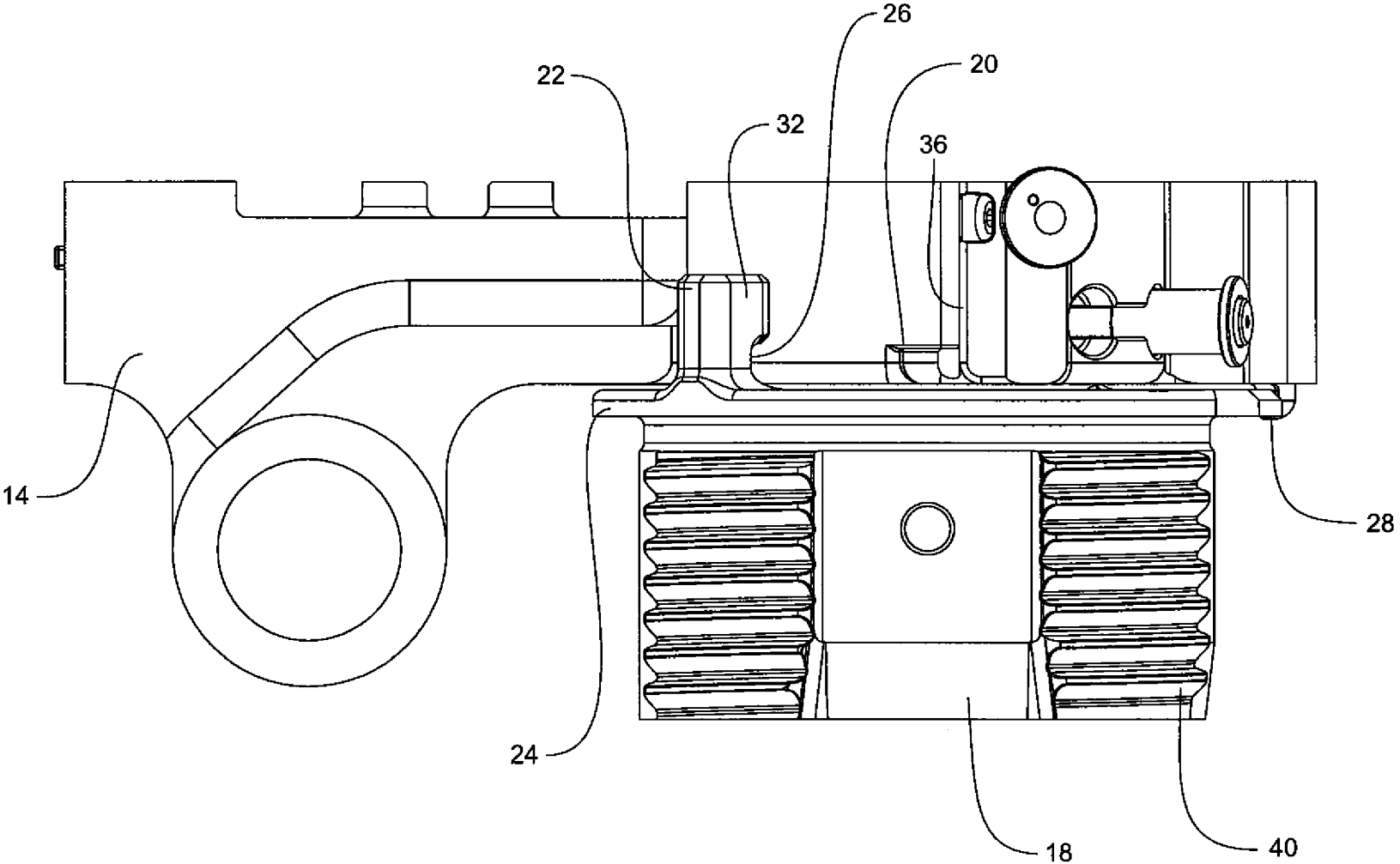
FIG. 5 is a side view of a screw breech block and carrier assembly with the screw breech block in the released position.

A supporting projection 22 may be disposed on a rear surface 24 of screw block 18. Supporting projection 22 may include an undercut portion 26 (FIGS. 5-7). A spring-loaded plunger 28 may be disposed on carrier 14. A plunger recess 30 (FIGS. 6-7) may be defined in rear surface 24 of screw block 18. Rotation of screw block 18 on breech block support 16 may be constrained by first and second barrier surfaces 36, 38 on carrier 14.

In the retained position of screw block 18 (FIGS. 2-4), undercut portion 26 of supporting projection 22 may engage supporting protuberance 20 of carrier 14 and spring-loaded plunger 28 may engage plunger recess 30. Supporting projection 22 of screw block 18 may include a first stop surface 32. In the retained position of screw block 28, first stop surface 32 may abut first barrier surface 36 of carrier 14. In FIGS. 2-4, plunger 28 is extended to lock the rotation of screw block 28 after threads 40 of the screw block 28 have disengaged from a breech ring (not shown) and before swinging open carrier 14.

FIG. 5 is a side view of the screw breech block and carrier assembly with screw breech block 18 in the released position. FIG. 6 is a perspective view of FIG. 5. Supporting projection 22 of screw block 18 may include a second stop surface 34 (FIGS. 2-4). In the released position of screw block 18, second stop surface 34 may abut second barrier surface 38 (FIGS. 2-4 and 7) of carrier 14. In the released position of screw block 18, spring-loaded plunger 28 may be disengaged from plunger recess 30 and undercut portion 26 of supporting projection 22 may be disengaged from supporting protuberance 20 of carrier 17.

FIG. 7 shows screw block 18 removed carrier 14.

In the retained position of screw block 18 shown in FIGS. 2-4, rotation of screw block 18 may be locked by engaging spring-loaded plunger 28 attached to carrier 14 with plunger recess 30 in screw block 18. Screw block 18 may be retained on carrier 14 by engaging supporting protuberance 20 disposed on carrier 14 with supporting projection 22 disposed on screw block 18. Retaining screw block 18 on carrier 14 may include engaging supporting protuberance 20 with undercut portion 26 of supporting projection 22.

Screw block 18 may be unlocked or released by removing spring-loaded plunger 28 from plunger recess 30. Spring-loaded plunger 28 may be, for example, manually depressed. Then, screw block 18 may be rotated to the released position shown in FIGS. 5-7.

An advantage of the invention is that screw block 18 may be automatically retained. Maintenance of the breech assembly may be safely and quickly performed by one person. Screw block 18 will not fall off until it is manually disengaged.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus configured for the breech end of a breech-loaded weapon, comprising:

a carrier having a breech block support;

a screw block that is rotatable on the breech block support of the carrier;

a supporting protuberance disposed on the carrier;

a supporting projection disposed on a rear surface of the screw block, the supporting projection including an undercut portion;

a spring-loaded plunger disposed on the carrier; and a plunger recess defined in the rear surface of the screw block;

wherein, in a retained position of the screw block, the undercut portion of the supporting projection engages the supporting protuberance of the carrier and the spring-loaded plunger engages the plunger recess.

2. The apparatus of claim 1, wherein rotation of the screw block on the breech block support is constrained by first and second barrier surfaces on the carrier.

3. The apparatus of claim 2, wherein the supporting projection of the screw block includes a first stop surface and further wherein, in the retained position of the screw block, the first stop surface of the screw block abuts the first barrier surface of the carrier.

4. The apparatus of claim 3, wherein the supporting projection of the screw block includes a second stop surface and further wherein, in a released position of the screw block, the second stop surface of the screw block abuts the second barrier surface of the carrier.

5. The apparatus of claim 4, wherein, in the released position of the screw block, the spring-loaded plunger is disengaged from the plunger recess.

6. The apparatus of claim 5, wherein, in the released position, the undercut portion of the supporting projection is disengaged from the supporting protuberance of the carrier.

7. A breech-loaded weapon, comprising:

a carrier disposed at a breech end of the weapon, the carrier having a breech block support;

a screw block that is rotatable on the breech block support of the carrier;

a supporting protuberance disposed on the carrier;

a supporting projection disposed on a rear surface of the screw block, the supporting projection including an undercut portion;

a spring-loaded plunger disposed on the carrier; and a plunger recess defined in the rear surface of the screw block;

wherein, in a retained position of the screw block, the undercut portion of the supporting projection engages the supporting protuberance of the carrier and the spring-loaded plunger engages the plunger recess.

8. The weapon of claim 7, wherein rotation of the screw block on the breech block support is constrained by first and second barrier surfaces on the carrier.

9. The weapon of claim 8, wherein the supporting projection of the screw block includes a first stop surface and further wherein, in the retained position of the screw block, the first stop surface of the screw block abuts the first barrier surface of the carrier.

10. The weapon of claim 9, wherein the supporting projection of the screw block includes a second stop surface and further wherein, in a released position of the screw block, the second stop surface of the screw block abuts the second barrier surface of the carrier.

11. The weapon of claim 10, wherein, in the released position of the screw block, the spring-loaded plunger is disengaged from the plunger recess.

12. The weapon of claim 11, wherein, in the released position, the undercut portion of the supporting projection is disengaged from the supporting protuberance of the carrier.

* * * * *